US008602810B2

(12) United States Patent
Brünger

(10) Patent No.: US 8,602,810 B2
(45) Date of Patent: Dec. 10, 2013

(54) RECTANGULAR CLOSING DEVICE WITH A TRANSLATIONAL AND ROTATIONAL MOTION

(75) Inventor: Mario Brünger, Bad Oeynhausen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/062,751

(22) PCT Filed: Aug. 18, 2009

(86) PCT No.: PCT/EP2009/005986
§ 371 (c)(1), (2), (4) Date: Apr. 20, 2011

(87) PCT Pub. No.: WO2010/028738
PCT Pub. Date: Mar. 18, 2010

(65) Prior Publication Data

US 2011/0189872 A1 Aug. 4, 2011

(30) Foreign Application Priority Data

Sep. 12, 2008 (DE) ..... 10 2008 047 145

(51) Int. Cl.
*H01R 13/62* (2006.01)

(52) U.S. Cl.
USPC ..... 439/372

(58) Field of Classification Search
USPC ..... 439/372, 620, 271–275, 349
See application file for complete search history.

(56) References Cited

U.S. PATENT DOCUMENTS 3,233,204 A * 2/1966 De Vore, Jr. ..... 439/333
5,273,455 A * 12/1993 MacLellan ..... 439/387

(Continued)

FOREIGN PATENT DOCUMENTS

DE 73 21 612 U 6/1975
DE 201 12 202 U1 3/2002

(Continued)

OTHER PUBLICATIONS

Chinese Patent Office—Office Action in Counterpart Application—Dated Nov. 15, 2012.

*Primary Examiner* — Chandrika Prasad
(74) *Attorney, Agent, or Firm* — Nath, Goldberg & Meyer; Jerald L. Meyer; Scott C. Langford

(57) ABSTRACT

The environmental conditions encountered in industry are not equally suitable for all connectors. Therefore, office connecting technology is rarely used in industry. In order to allow the use of office connecting technology in industry, wall leadthroughs such as are used in the construction of switchboards and appliances are used and cover plug contacts when the plug receiving elements are not used or cover wall passages. The predominantly square or rectangular wall passages also have fastening and positioning means in the form of mounting frames for such connectors. Said mounting frames are covered, e.g. with caps, when not in use in order to close the connector passage or already existing contacts off from unfavorable environmental conditions. The invention relates to a closing device of the above type in the form of a premounted closing element for sealingly closing a connector leadthrough and comprises means for repeatedly closing and opening the leadthrough, the device being easy to handle due to the fact that it can be simply pushed onto the leadthrough and slightly twisted to open (push & twist).

7 Claims, 4 Drawing Sheets

(56) References Cited

U.S. PATENT DOCUMENTS

Figure 1:
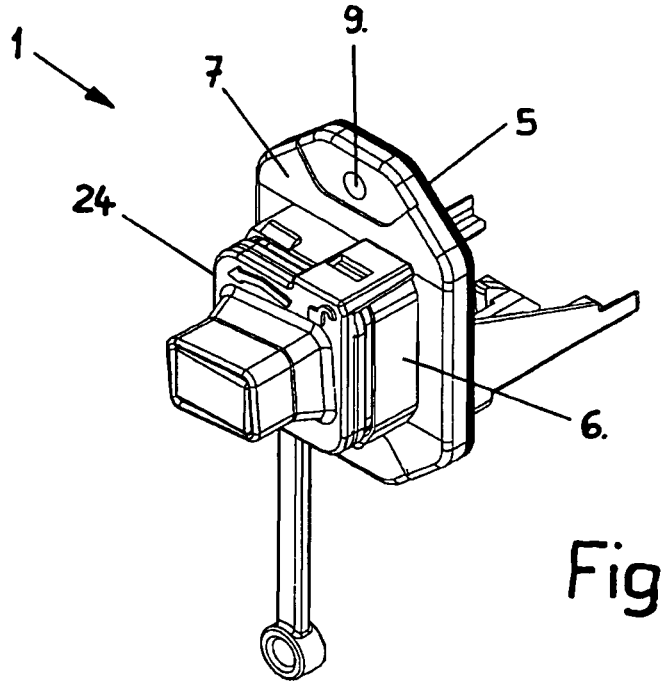

| | | | | |
|---|---|---|---|---|
| 5,554,044 | A * | 9/1996 | Nishide | 439/352 |
| 6,135,811 | A | 10/2000 | Daoud | |
| 7,845,986 | B2 * | 12/2010 | Yasumura et al. | 439/637 |
| 7,909,615 | B1 * | 3/2011 | Yasumura et al. | 439/66 |
| 8,079,848 | B2 * | 12/2011 | Yasumura et al. | 439/66 |
| 2006/0089049 | A1 | 4/2006 | Sedor | |
| 2007/0004255 | A1 | 1/2007 | Kuo | |
| 2007/0036489 | A1 | 2/2007 | Grzegorzewska et al. | |
| 2013/0095692 | A1 * | 4/2013 | Cole | 439/372 |

FOREIGN PATENT DOCUMENTS

| | | | |
|---|---|---|---|
| DE | 2011 2202 | U1 | 3/2002 |
| DE | 602005003141 | | 10/2007 |
| JP | 63-102186 | U | 7/1998 |

* cited by examiner

RECTANGULAR CLOSING DEVICE WITH A TRANSLATIONAL AND ROTATIONAL MOTION

This is a National Phase Application filed under 35 USC 371 of International Application No. PCT/EP2009/005986, filed on Aug. 18, 2009, an application claiming foreign priority benefits under 35 USC 119 of German Application No. 10 2008 047 145.3, filed on Sep. 12, 2008, the content of each of which is hereby incorporated by reference in its entirety.

TECHNICAL FIELD

The use of the invention relates to the field of angular electrical connectors, or mounting frames in wall passages for such connectors, particularly to a closing device for sealingly closing the contact connection of this connector or of a square or rectangular reception frame of a wall passage for such connectors, which are used in a harsh application environment on switch cabinets or apparatuses, where the closing device in question here relates to an advantageously attachable closing device, which is provided for multiple closing as well as subsequent opening of a contact connection of a connector passage or a plug connection in the form of an angular mounting frame.

STATE OF THE ART

On switch cabinets or industrial electrical apparatuses, under harsh and dirty environmental conditions, data connections are frequently connected directly to the apparatus wall of a switch cabinet or an electronic apparatus, so that the control or other electronic system to be protected does not already become soiled beforehand during daily operation, and in the case of a connection of a connector, as a result of industrial environmental conditions. The apparatus walls are here provided with square or rectangular standard wall passages, where the wall passages correspond to prefabricated wall cut-outs. However, frequently not all the provided cut-outs are needed, so that unused switch cabinet wall cut-outs have to be closed with sealing cover plates for a later use of mounting frames of different connectors. In order to be able to omit a subsequent conversion of these potential places of use at the site of use of the switch cabinet or apparatus, the wall passages are often already preconverted with a plurality of different connectors. Such connector passages or connections consist, for example, of adapter plates and/or insertion or mounting frames, and they have the advantage that they can be completed more rapidly with a connector to be connected. Depending on the environment, these insertion or mounting frames are closed by means of a cover part which seals these plug connections. As a rule, this presents problems if only individual connections are to be used. The closing devices in question here satisfy, in combination with the mounting frame known from the state of the art, only the protection types IP 11 to IP 54.

Mounting frames, passages or plug contact connections at wall passages are as a rule designed as attachment or positioning means for electrical connectors which can be attached or inserted, which are premounted in or at the wall passage, and which have not only a contact connection for a connector, but also an attachment of the connector against unintended pulling out of the connector. As is known from the state of the art, such mounting frames exist in many designs. Examples of different mounting frames from the state of the art can be obtained from the product catalog "Industriesteckverbinder PLUSCON 2007 [PLUSCON 2007 Industrial Connectors]" MNR 52002299/15.03.2007-00 on page 198 and following, of the company Phoenix Contact GmbH& Co KG.

In particular, covers for round connectors are known which, in the form of caps or plugs, present a sufficiently good cover against dirt and humidity. They are used because of their round shape, for example, in the form of cover caps, protective covers, and dummy plugs, and provided much more easily with sealing contours, than plugs or covers for angular plug connectors. However, since increasingly more connectors from the office sector are also used in the industrial sector, RJ-45 or USB connectors, for example, are used increasingly in industrial switch cabinets for controls or in field apparatuses. With these connectors in particular, prefabricated mounting frames or screw-on housing parts of the given connector are used almost exclusively. The connection surface of the reception housings of these above-mentioned connectors is frequently square or rectangular in design. Accordingly, for closing, different closing parts, for example, cover caps, protective covers, etc., and/or dummy plugs, or a combination of different closing elements is (are) used. A protective cover, which is similar to the design of a connector, and a dummy plug, both being part of the state of the art, can also be found in the above-mentioned product catalog.

However, the disadvantage of the known closing elements is that the requirement for a sealing plug connection to the shape of the closure, to achieve a required firm seat, must overcome a considerable effort in the handling. In the case of simple handling, the seat at the sealing place may also be too loose to allow sealing. To improve the handling, these closing elements have therefore often been given appropriately large dimensions, which is disadvantageous in terms of space requirement, and which can lead, in the case of careless handling, to unintentional pulling off, uncontrolled falling off in case of vibrations of the closing plug on the switch cabinets or apparatus, or, in the case where the design is too small for manual operation of the closing plug, to the need for additional tools which can damage the closing element or even the wall passage.

This is particularly disadvantageous when such a removable closing plug, as dummy plug in a connector passage, has the function of sealing according to IP 67 according to the requirements of DIN EN 60529. In case of low protection requirements, for example, the protection requirement according to protection type IP 54, the requirements for the closing element are still satisfied. However, in case of increasing protection requirements for the connector passage against dust and water, for example, according to protection type IP 67, additional construction measures are needed, which must comply with the standard.

One problem to improve the state of the art thus consists in designing a connector passage or a mounting frame in a more reliable way, and with a construction such that a higher protection type than IP 54 in accordance with DIN EN 60529 is guaranteed. Moreover, the problem is based on producing a reusable closing device of the type mentioned in the introduction for nearly square or rectangular wall passages, or connection places on apparatuses for precisely such square or rectangular connectors, which avoids the above-mentioned disadvantages of the known covers, and presents a technical solution which enables a repeatable sealing closing and a simple opening of a closing element. Here, the closing and opening of a connector passage in particular should be achievable in a simple way and without considerable force or the use of an additional tool.

Solution of the Problem

According to the invention, this problem is solved by the characterizing features of Claim 1. Advantageous embodiments and variants of the invention result from the claims below and the description below.

Here, a higher protection level is reached, for example, the protection type IP 67 to IP 68 according to DIN EN 60529, the electrical/electronic operating means in switch cabinets or housings for safety reasons against environmental influences. A falling out of the closing element out of the connector passage due to incorrect handling is no longer possible due to the provided latching of the device.

In concrete terms, the solution consists of a "push and twist" device which is mainly formed from a single formed piece. The formed piece can be manufactured from different materials, and it is manufactured preferably from plastic. However, it can also be manufactured as a metal sleeve or as a connecting part made of metal and plastic. The formed piece presents three functional elements. A small gripping and actuation element which is advantageous for the handling, a load transmission element, and at least one latching element, which are interconnected forming one piece. Here, the formed piece of the closing plug itself forms a cap-like, substantially hollow, protection cover, which functions both as closing and opening element. The closing plug consists of a substantially hollow sealing part with a square or rectangular cross section, followed by a protruding short stabilization cone which transitions into a grip piece for handling. Here, the walls facing the open side of the closing plug form the sealing parts, which are formed by means of a flange which covers the mounting frame opening, on the stabilization cone, forming a single piece, as part of a sealing rubber.

An additional functional element of the device is a closing element, which receives parts of the closing plug in a geometrically adapted form, and retains them. Here, this closing element has a flange part, which, in the plugged together state, is applied with the closing plug on its flange, and supports it mechanically. Moreover, the closing element, in the direction of attachment, has two protruding, flat connection parts which are flexible with spring action directed towards the outside, which firmly interconnects both parts, for the attachment of the sealing element on corresponding protruding engagement pieces on the mounting frame. Here, the leading latching pieces envelop the mounting frame, where, at the same time, the closing plug is immersed into its frame opening. The latching pieces which protrude in the insertion direction consist of two tabs forming an angle and provided on the flange of the closing element, and arranged diagonally opposite and parallel to each other at some separation. The tabs point in the direction of the front side of the mounting frame, where the tabs contain engagement means which correspond to the front-side engagement means of the mounting frame. Here, the type of these engagement means can be of the greatest variety of shapes and designs. A firm connection between the mounting frame and the device is made when the engagement means, provided on the front-side margin of the attachment and positioning means, engage with the corresponding engagement means in the tabs of the device. When the device is plugged on the mounting frame, the two tabs, as a result of a shape suitable for that purpose, are pushed outward and engage with their engagement means after reaching the final position with the engagement means of the mounting frame. This process of the closure of a connector passage is referred to as a "push" process. It can, moreover, be perceived by the operator as a result of an acoustic clicking in the final position. The tabs that form the flange thus represent one of the functional elements of the closing element, whose function is to connect the device firmly with the mounting frame, and, moreover, detachably. Here, the tabs act as latching elements which, together with the engagement means arranged on them, press, after sliding is the push direction, a sealing part, which closes the opening, against the circumferential frame of the mounting frame. The separations between the axial contact of the closing plug and the latching position is adjusted to each other, so that here a slight pressure is generated on the closing plug flange, which supports the sealing effect. As a result, the protection type IP 67 and higher can be achieved. Due to the engagement with a mounting frame, the disadvantage of a falling out of the closing element from a connector passage due to incorrect handling or unintentional pulling off of the closing element is eliminated.

An additional function of the tabs is to receive, center, and clamp, the closing element in the closing device before the insertion into the connector passage. For this purpose, the tabs are designed in such a way that they enclose an outer margin of the three circumferential outer margins at two places of the closing element, attaching it to the circumferential outer margin, whose circumference is slightly greater than the two other circumferential outer margins. The two tabs arranged on the flange form an angle of approximately 90° in the push direction, and they are connected at two facing corners with the flange, forming one piece, where they point in the push direction, and thus in the direction turned away from the gripping and actuation part. The centering of the closing element in the device thus occurs due to the two tabs which are parallel with separation, and which enclose the outer margin of the circumferential margins, which are parallel at some distance, at two parallel and diagonally opposite places, with the result that the tabs form a centering means. Moreover, the tabs function as lateral stop for attachment means arranged on the closing element. The attachment means consists of a joining element which, on the one hand, is connected forming one piece at the outer margin to the closing element, and, on the other hand, for the purpose of preventing the pulling off of the closing element, presents at the free end of the tabs an attachment element, preferably an eye, by means of which the attachment on the housing can occur.

An additional functional element on this closing element is the load transmission element, which follows immediately after the flange of the closing element, and which receives in it an appropriately dimensioned part of the closing plug. For reasons of stability, the shape which is conical on all sides has an advantageous effect on the force distribution towards the sealing flange. The load transmission element is at the same time a gripping and actuation element. The above-described latching pieces are thus arranged on the side facing the mounting frame, where, on the back side of the flange, at the closing plug carrier, the gripping and actuation element are arranged. Depending on the construction design of a mounting frame, the external shape of the transmission element is of square or rectangular design. The load transmission element is connected to the flange part forming a single piece, where the forces that occur on the gripping and actuation element transmitted to this load transmission piece, and thus to the flange of the closing plug carrier. The passage is followed on the front side by the gripping and actuation element. The flange, the load transmission piece, and also the grip piece, are hollow in design, so that components of the closing plug that have a construction with equivalent contour can be inserted in them. The size of the hollow passage corresponds to the size of the grip piece attachment of the closing plug.

The third functional element to be mentioned is the gripping and actuation part, which is a component of the closing device. The gripping and actuation part consists in principle of a hollow middle part with rectangular cross section, which is arranged centrally with respect to the mounting frame of a connector. Here, the hollow body is formed from a truncated pyramid and the other of hollow body from a cuboid. The form of the hollow body corresponds, as described above, due to its material wall, to the shape of a grip piece. The gripping and actuation part must fulfill several functions. On the one hand, the gripping and actuation element should allow handling by the user, and, on the other hand, it should receive a grip piece of a closing plug. If a device is completed with a closing plug, the equivalent grip piece of the closing plug is located in the gripping and actuation part. For the "push and twist" process, the device can now be gripped by the user with his/her fingers on the gripping and actuation element. During the "push" process, the converted device is attached to the mounting frame, and during the "twist" process it is removed from the mounting frame by turning and pulling off. Here, during the "twist" process, the grip piece is twisted in the direction of the direction symbol represented on the flange surface. This has the consequence that, in the process, the inner rubber part of the closing plug, which is received by the gripping and load transmission part of the closing element, also twists. The resulting force action leads to an easy twisting of the flange part of the closing plug. However, this has no detrimental effect on function. Due to the twisting of the entire closing element by approximately 10°, the latching pieces which are connected with the closing element forming one piece, and protrude in the axial direction, are lifted from the outer surface of the mounting frame. This occurs advantageously for both diagonally opposite latching pieces. In the case of a twisting by approximately 10°, the engagement means are no longer in engagement on the mounting frame and on the latching piece, so that, in this position, the pressing of the closing plug flange generated before the attachment, pushes the closing element away from the sealing edge of the mounting frame. At the time of release, the engagement means thus no longer engage with each other. The closing element can be pulled off with overcoming of the frictional force of the jar-shaped sealing gasket. Since this process can be carried out as many times as desired without damaging the individual components, numerous attachment and disengagement processes are possible. Here, the gripping and actuation element fulfills several functions, summarized under the name "push" and twist."

Figure 2:
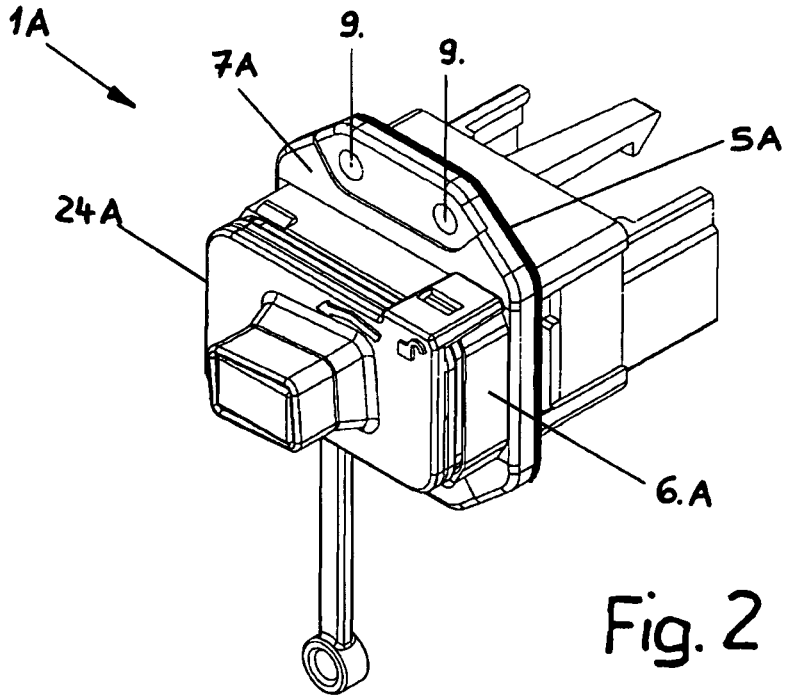
Figure 3:
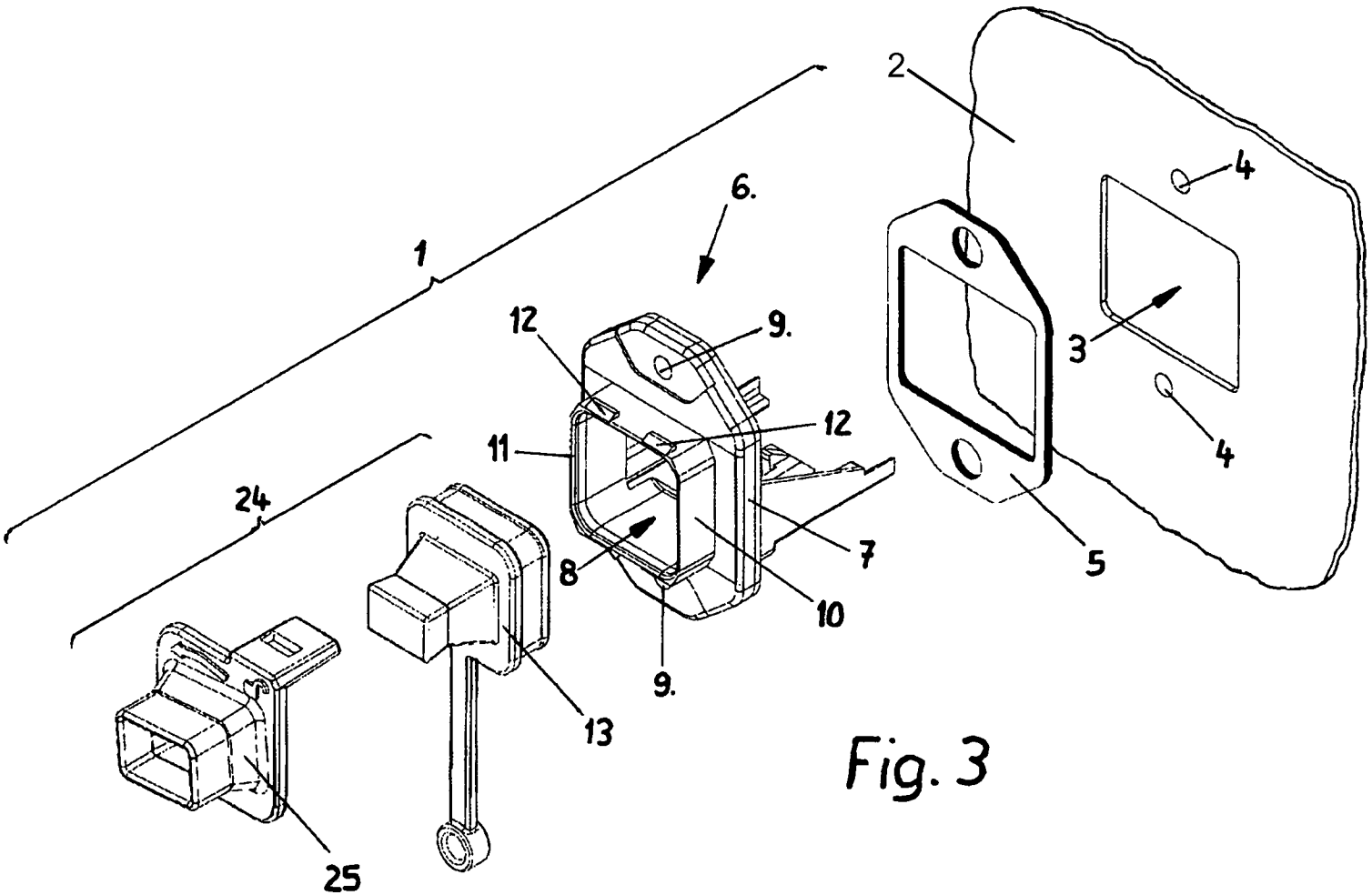
Figure 4:
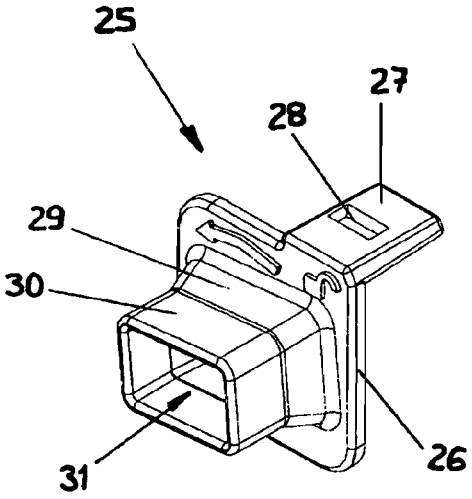

Such a "push and twist" device for sealingly closing and opening a connector passage is described in further detail below in an advantageous embodiment in an embodiment example of the invention, and explained in FIGS. 1-4 using reference numerals. The figures show FIG. 1 a perspective representation of an embodiment of a closure system for a single connector, consisting of a mounting frame, a closing device with dummy plug, and an anti-loss device FIG. 2 a perspective view of an embodiment of a closure system for a double connector, consisting of a mounting frame, a closing device with dummy plug, and an anti-loss device FIG. 3 a perspective representation of a device according to the invention with an exploded view with pulled apart components for sealingly closing and opening a wall passage, and FIG. 4 a perspective representation of a closing element according to the invention FIG. 5 a perspective representation of a closing plug according to the invention FIG. 6 a perspective representation of the closing device consisting of the assembled closing element with closing plug FIG. 7 a front representation for an alternative representation of the detachment of the latching from the mounting frame of the closing device FIGS. 1 and 2 represent embodiment examples of the closing device 1, 1A according to the invention for sealing and opening a connector for wall passages 3, with a mounting frame 6 and its sealing gasket 5, 5A for the attachment or incorporation in a device or switch apparatus wall 2, while FIG. 3 represents the complete closing device 1, 1A with the closing element 24 according to the invention in an exploded view showing all the individual parts of the closing device 1. Below, in FIGS. 4, 5 and 6, the individual components of the closing element 24 are described in detail. FIG. 4 illustrates the required twisting of the closing device 24, 24A according to the invention, and substantiates the claimed process description.

In detail, FIG. 1 shows, in a perspective representation, an embodiment of a closing device 1 in an assembled and in an attached and engaged closing element 24. To satisfy DIN EN 60529, a sealing gasket 5 is provided between the apparatus wall 2 (see FIG. 3) and the mounting frame 6. The frame opening 8 here extends into the wall passage 3 in the apparatus wall 2. The frame opening 8 is closed by means of a closing element 24. This embodiment for sealing and opening a connector frame opening 8 is very expensive in terms of construction. To be able to close the closing device 1 mounted in this representation repeatedly with a closing element 24, the closing element 24 has been provided with an anti-loss device 20, 21, 22.

FIG. 2 shows a closing device (1A) which is provided, for example, for two adjacently arranged connectors. Here, the mounting flange 7 has become accordingly broader by a certain measure; however, not as broad as two individual connectors next to each other. Accordingly, the frame opening 8 has been broadened, so that a closing element (1) of an individual connection no longer seals. Since, in the case of broader closing devices 1A as well, which, moreover, have also been attached by means of several attachment means to a housing or apparatus wall, a gasket seal is required, the components of the closing element have been enlarged in terms of their width towards the small side. The design is the same as for the closing device 1, whose individual parts are described below.

To represent, on the one hand, the sequence of assembly of a closing device 1, it are shown in an exploded, pulled apart, view in FIG. 3. Here, a wall passage 3 and holes for attachment means 4 are provided on a housing or apparatus wall 2. The cut-out is here adapted to the required dimensions of a mounting frame, or on another square or rectangular wall passage part. The present embodiment example shows a mounting frame 6 which can be screwed to a housing or apparatus wall by means of a contact flange 7. When this flange 7 itself, on its stop surface facing the apparatus wall 2, presents no injection molded sealing gasket provided with a flange in a circumferential groove, one usually uses stamped flat sealing gaskets 5 made of a soft sealing material. The mounting frame with the sealing gasket arranged in between is screwed with attachment means (not shown) to the apparatus wall.

Frequently, mounting frames 6 are designed with a protruding frame piece 10, to which the connectors (not shown) to be connected can be attached. The protruding frame piece 10 here encloses a frame opening 8, in which the contact parts of a connector are connected with other contact parts. In the regular case, it is intended to provide protection against unfavorable environmental conditions. Here, the connector is attached to the engagement means 12 in such a way that, on the one hand, it is connected firmly to the mounting frame, and, on the other hand, it requires no additional means for the attachment. These engagement means are provided on the outward facing circumferential surface of the protruding frame piece. If some connectors are not connected, one frequently uses closing plugs which are inserted in this protruding frame piece 10.

The mounting frame 6 presents, besides a flange 7 with a central opening 8, preferably two bores 9, for the attachment to the apparatus wall 2. The frame opening 8 is enclosed by a square thin wall, as protruding frame piece 10, which protrudes in the push direction. Moreover, the frame opening 8, and thus the protruding frame piece 10 present a square design, or a rectangular design as in FIG. 2. This circumferential, protruding and circumferential wall is connected, forming one piece, to the contact flange 7 of the wall passage. On the outside of this protruding frame piece 10, engagement means 12 are provided, preferably in the form of engagement noses. The engagement means 12 are arranged on two parallel facing sides, on the top and the bottom side of the outward facing circumferential protruding frame piece 10. To secure the connectors sufficiently, in each case two engagement means 12, of the four engagement means represented here that are present, are arranged adjacently with some separation, on the above described surfaces. Mutually facing other outer sides of the frame piece 10 present no engagement means 12. The engagement means 12 serve to attach an attachable connector housing (not shown).

The mounting frame 6A represented here shows, in a schematic representation, the same characteristics as the mounting frame 6 represented in FIG. 1 already did, and, consequently, given the similarity of the description of the disclosed mounting frame 6, it is not described in greater detail.

Figure 5:
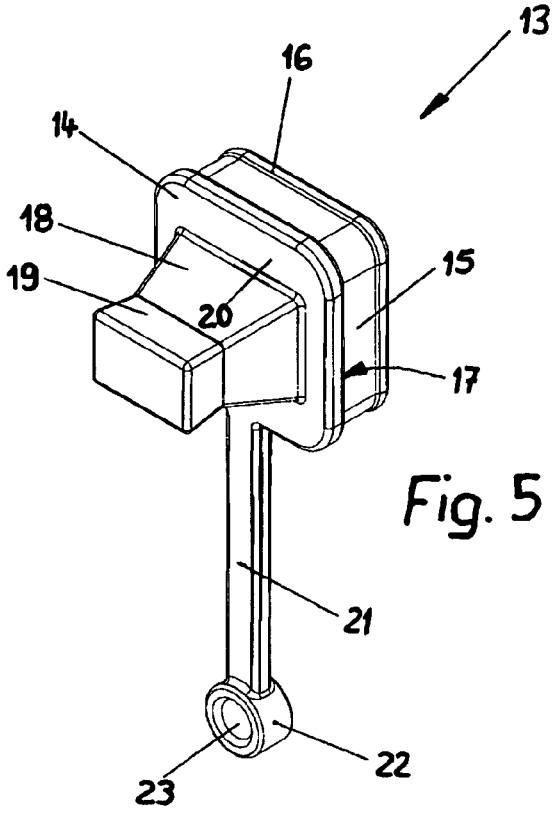
Figure 6:
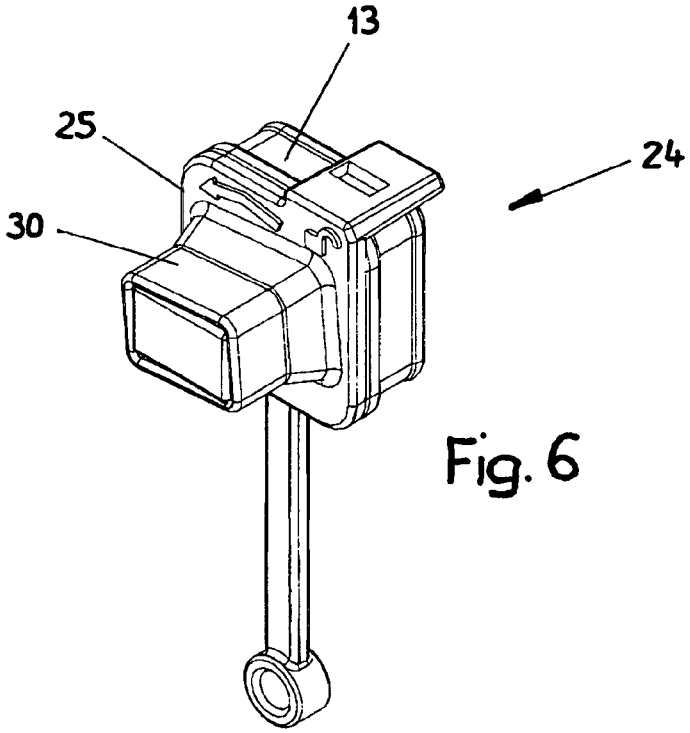

In FIG. 3, the usually premounted closing element 24 is represented pulled apart. To be able to describe the individual features of the individual components, the latter are represented in FIG. 4 and FIG. 5 in the same arrangement, where FIG. 6 shows the complete part, ready for use. A component that contributes to the invention is the closing plug carrier 25. It consists of a flange part 26 on which, on the operator side, a joining cone 30 and a grip part 30 are formed. The closing plug carrier is of hollow design, so that an equivalently designed part 18, 19 of the closing plug 13 according to FIG. 5 can be inserted in it. On the circumferential flange part, mutually diagonally positioned latching pieces 27 are provided, which are oriented at a right angle to the flange surface in the push direction towards the wall. In the state assembled with the closing plug, both latching piece extend in a diagonal arrangement above the jar-like sealing wall.

The closing plug carrier 25 according to FIG. 4 is manufactured from metal or preferably from plastic. The closing plug carrier 25 is formed from a formed piece, which consists of three functional parts that are interconnected to form one piece. The three functional parts consist of a grip piece 30, a joining cone 29, and a flange part 26, which together form a cap-like protective cover, which functions as closure, and as opening element. From the geometric point of view, the closing plug carrier 25, depending on the construction design of the mounting frame 6, 6A, is in principle a small tube piece, with square or rectangular design, with flange 26 formed on it. The flange 26, in terms of its external dimensions, corresponds approximately to the body shape of the closing plug 13. The front and back side of the flange 26 and in each case present a planar surface, against which the stop surface 20 of the closing plug rests.

Here, in FIG. 5, the closing plug 13 is represented, which is manufactured from an elastic material, preferably rubber, and which corresponds, in terms of its body shape, to a cuboid, and which corresponds to the shape of the frame opening 8 in the mounting frame 6. Depending on the embodiment of the mounting frame 6, the frame opening 8 can present a square or rectangular design.

The square or rectangular shape of the closing plug 13 presents, on its external circumference, two circumferential margins 16, 17, which are separated by a circumferential sealing attachment 15. The external edge 16 of the closing plug 13 forms a circumferential margin similar to the design of an O-ring, whose external dimension is slightly larger than the dimension of the frame opening 8 in the mounting frame 6, to achieve a reliable seal. On the front-side frame edge 11, the circumferential stop surface 17 is, in its external dimension, again greater by a certain amount in circumference, compared to the circumferential frame edge 11. This circumferential stop surface 17 with larger external dimension is necessary, because the frame opening 8 on the frame piece protruding on the front presents a small bevel or insertion slant for the insertion of the sealing gasket.

Perpendicularly to the circumferential margin, which is formed by the stop surface 17 for the frame edge 11, in the middle, an attachment means, preferably an attachment band 21, is connected to the closing plug 13 forming one piece, and, on its free end, it presents an eye 22, by means of which the closing element 24 can be kept with protection against loss, on the mounting frame 6, particularly on its attachment screws, for the attachment to the apparatus wall 2. The attachment band 21, due to its material and its design, has an elastic form, whereby the eye 22 can be attached to the recessed apparatus wall 2 or to the mounting frame 6.

The cuboid closing plug 13 presents, on its square rectangular shape of the front side or stop surface 20, an attachment and grip part 18, 19, which is manufactured forming one piece with a closing plug, and from the same material, and which protrudes centrally out of this surface 20. The attachment and grip part 18, 19 in turn is formed from two geometric bodies forming a single piece, a truncated pyramid-like stabilization cone 18 with rectangular base, and an attached cuboid attachment and grip part 19, where the truncated pyramid is arranged directly perpendicularly on the stop surface 20, and the cuboid forms the free end of the grip piece 19.

Both components according to FIG. 4 and FIG. 5 are inserted into each other in their functionally correct completion, namely in such a way that the attachment part 19 is first pressed into the joining cone 29, and then into the grip piece 30. Because the reception opening 31 should present only small differences compared to the dimensions of the attachment part 19 and stabilization cone 18, joining by hand is not possible without effort. It is preferred that these parts are premounted by machine.

During the closing of the frame opening 8 of the mounting flange 6, the handling of this closing element 24 is not different from that during normal use of a closing plug known from the state of the art. The advantages in comparison to the closing plugs known from the state of the art consist, on the one hand, in that, during the attachment process, for the purpose of sealing the frame opening 8, leading latching pieces 27 secure the closing element 24 mounting frames, so that the latter cannot be pulled off unintentionally by an operator, or fall off the mounting frame 6 due to vibrations. The translational movement generated on the stabilaztion cone 18 and attachment/grip part 19, to push the closing element 24 on the mounting frame 6, and the applied compressive force in the axial push direction, shortly before the engagement of the engagement means 12 in the engagement means opening 28, leads to clamping the axial sealing flange 14 between the frame edge 11 and the flange part 26. After overcoming the required insertion depth, and the associated compression of the sealing flange 14, the engagement means 12 and the engagement means opening 28 engage in an acoustically perceivable way. Thus, the noise of a "double click" can provide an indication of the engagement of the latching pieces 27, 12, which then do not also have to be tested optically to verify the engagement.

On the other hand, the advantage during the detachment and removal of the closing element 24 is much greater, than the closure of the frame opening 8. To substantiate this, reference can be made to FIG. 7. If on the grip piece 30, which transitions into the fitting cone 29, a counterclockwise turning motion is produced, then, due to the plugged in connection between the flexible closing plug 13 and the closing plug carrier 25, a rotatory connection will occur between the stabilization cone and the contact flange 20 of the closing plug. However, due to the small twist angle 30, this is not damaging for the sealing component. Here, the twist angle 32 is in a relation of dependency on the required stroke 33 of the latching piece 27.

Figure 7:
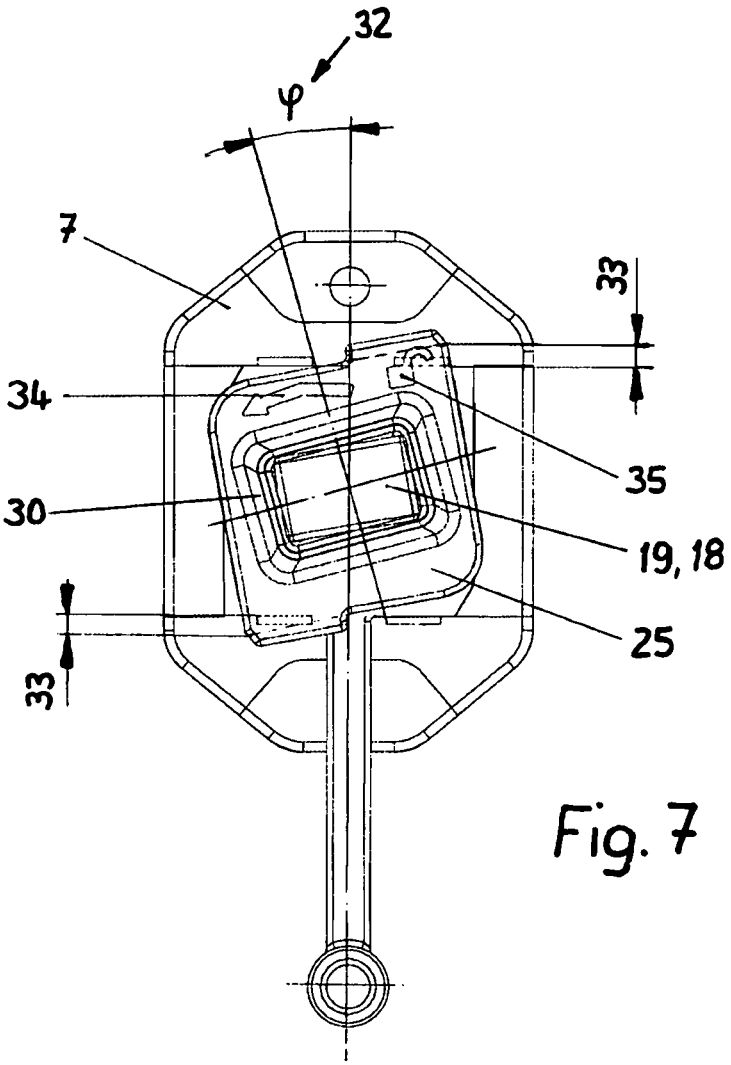

As a result of a turning motion generated on the grip piece 19, 18, the latching piece 27, in the first step, is lifted from the engagement means 12 arranged on the frame piece 10 which protrudes on the front side, and thus released. The piece, if the stroke 33 is sufficient, is lifted out of the retention edge of the engagement means 12, so that the resetting forces of the compressed sealing flange 14 bring the engagement means 12, 28 out of engagement. In the second step, due to the further turning motion on the grip piece 19, 18, a twisting of the elastic components, which has already been mentioned above, occurs. Simultaneously with the turning motion, a compressive force is exerted due to the compressed flange 14 of the jar-like closing plug 13 during the closure, on the grip piece 19, 18. Because of the generated pressure force, the closing element 24 is pressed by of the mounting frame 6. Due to the effect of the torque on the closing element 24 and the compressive force of the compressed flange material 14, the closing element, if the latch is loosened, is released for removal, and can be pulled out of the frame opening 8 of the mounting frame 6. The force required for loosening the closing element 24 from the mounting frame 6 by an applied torque is comparatively small, but increases shorter lever arms and strongly protruding engagement means 12. FIG. 7 shows a generated twist angle 32 in case of simultaneous lifting (lift 33) of the latching pieces from the engagement means 12. The engagement means 12 can also be formed from an engagement hook or an engagement nose. The engagement hook is formed on the inner side of the side of the mounting frame 6 that faces the front-side margin 11.

LIST OF REFERENCE NUMERALS

1 Closing device
2 Apparatus wall
3 Wall passage
4 Bore for attachment means
5 Scaling gasket
6 Mounting frame
7 Contact flange
8 Frame opening
9 Attachment bore
10 Protruding frame piece
11 Frame edge
12 Engagement means
13 Closing plug
14 Scaling flange
15 Scaling attachment
16 Sealing lip
17 Stop surface for frame edge
18 Stabilization cone
19 Attachment grip part
20 Stop surface
21 Attachment band
22 Eye
23 Attachment bore
24 Closing clement complete
25 Closing plug carrier
26 Flange part
27 Leading latching piece
28 Engagement means opening
29 Joining cone
30 Grip piece
31 Reception opening
32 Twist angle
33 Stroke
34 Turning direction arrow
35 Opening symbol

The invention claimed is:

1. A closing device (1) for closing and opening a connector wall passage, the closing device (1) comprising:

a closing element (24) and a mounting frame (6), wherein:

the closing element (24) is attached to the mounting frame (6) by a translational movement, and the closing element (24) can only be removed after a turning motion and an opposite translational of the closing element 24; wherein:

the closing element (24) is assembled by plugging together a closing plug carrier (25) and a closing plug (13), closing plug (13) comprising an elastic material;

the mounting frame (6) comprises a protruding frame piece (10) having engagement means (12) on a circumferential outer surface of the protruding frame piece (10), and the closing plug (13) and the protruding frame piece (10) having corresponding square or rectangular cross-sections;

the closing element (24) comprises at east one latching piece (27) which can be attached to the mounting frame (6);

the at least one latching piece (27) is slid onto the circumferential outer surface of the protruding frame piece (10), during the attachment of the closing element (24);

the engagement means (28), during the attachment of the closing element (24), is connected with a corresponding engagement means (12) of the protruding frame piece (10); and the position of the latching pieces (27) of the closing plug carrier (25) and the corresponding engagement means (12) of the protruding frame piece (10) are arranged diagonally and parallel to each other with separation, and opposite in each case at one corner of the square or rectangular cross section of the protruding frame piece (10), and whereby the turning motion of the closing element (24) releases the at least one latching pieces (27) from the corresponding engagement means.

2. The closing device (1) according to claim 1, wherein the engagement means (28) is selected from a group consisting of an opening, a recess or engagement hook.

3. The closing device (1) according to claim 1, wherein the closing plug carrier (25) and the at least one latching piece (27) form one piece.

4. The closing device (1) according to claim 1, wherein the closing plug (13) forms a jar-like contour with the square or rectangular cross sections, whose bottom is formed by a closed sealing flange.

5. The closing device (1) according to claim 4, wherein the closing plug (13) further comprises a stabilization cone (18) and an attachment part (19) forming a single-piece formed part for manual actuation.

6. The closing device (1) according to claim 5, wherein the closing plug carrier (25) further comprises a joining cone (29) and a grip piece (30) adapted to the stabilization cone (18) and the attachment part (19) for manual actuation.

7. The closing device (2) according to claim 4, wherein the closing plug (13) further comprises an attachment band (21) with an eye (22) attached so as to form a single piece, as an anti-loss device.

* * * * *